United States Patent [19]

Kelly et al.

[11] 4,382,540

[45] May 10, 1983

[54] DOUBLE-DOOR SECURITY RURAL MAIL-BOX

[76] Inventors: James B. Kelly; Viola F. Kelly, both of 7255 Shelby St., Indianapolis, Ind. 46227

[21] Appl. No.: 168,126

[22] Filed: Jul. 14, 1980

[51] Int. Cl.[3] ..... B65D 91/00

[52] U.S. Cl. ..... 232/17; 232/45

[58] Field of Search ..... 232/17, 35, 34, 45, 232/41 D

[56] References Cited

U.S. PATENT DOCUMENTS

| | | | |
|---|---|---|---|
| 975,455 | 11/1910 | Prevost | 232/41 D |
| 1,038,583 | 9/1912 | Hodgkinson | 232/41 D |
| 1,110,779 | 9/1915 | Hartman | 232/41 D |
| 1,219,360 | 3/1917 | Storms | 232/41 D |
| 1,305,722 | 6/1919 | Kees | 232/41 D |
| 1,458,200 | 6/1923 | Sloan | 232/41 D |
| 1,478,552 | 12/1923 | Chapman | 232/41 D |
| 3,106,335 | 10/1963 | Allan | 232/17 |
| 3,675,845 | 7/1972 | Scheerer | 232/35 |
| 3,758,027 | 9/1973 | Morgan | 232/17 |
| 3,891,139 | 6/1975 | Redling | 232/35 |
| 4,005,816 | 2/1977 | Malik | 232/17 X |
| 4,220,278 | 9/1980 | Hasselbring | 232/35 |

FOREIGN PATENT DOCUMENTS

| | | | |
|---|---|---|---|
| 62625 | of 0000 | Fed. Rep. of Germany | 232/17 |
| 422682 | 1/1935 | United Kingdom | 232/41 D |

*Primary Examiner*—Roy D. Frazier
*Assistant Examiner*—Peter A. Aschenbrenner
*Attorney, Agent, or Firm*—Woodard, Weikart, Emhardt & Naughton

[57] ABSTRACT

A double-door security rural mailbox having oppositely faced front and rear closures permitting safe, easy access thereto by the rural mail carrier and the owner of the mailbox. The mailbox has a locking mechanism including a key operated lock for locking the rear closure. The front closure is provided with a locking mechanism which allows the front closure to be freely opened and closed once by the mail carrier before securing in a locked position. Thereafter, the front closure may only be unlocked by unlocking and opening the rear closure. Once the rear closure is again closed and locked, the front closure may again be opened and closed once by the mail carrier before securing in a locked position.

9 Claims, 10 Drawing Figures

DOUBLE-DOOR SECURITY RURAL MAIL-BOX

BACKGROUND OF THE INVENTION

1. Field of the Invention:

The present invention relates generally to the field of depository receptacles, and more specifically to mailboxes of the double-door type.

2. Description of the Prior Art:

Depository receptacles, such as the standard type rural mailbox are commonly characterized by a single access opening which is readily accessible to authorized persons, as for example, the rural mail carrier. This easy accessability feature, while being a distinct advantage to mail carriers, does pose certain disadvantages for the owner of the mailbox. For instance, the access opening must face the road upon which the mail carrier travels. This means that in order to retrieve the contents from the mailbox, a person must stand dangerously close to, if not directly upon, the roadway. One solution to this problem is to design a double-door mailbox wherein access openings are oppositely faced on either end of the mailbox. Double-door mailboxes are disclosed in U.S. Pat. No. 3,106,335 to Allan; U.S. Pat. No. 4,005,816 to Malik; and U.S. Pat. No. 4,220,278 to Hasselbring.

Another disadvantage associated with conventional type rural mailboxes is that the need for easy access by mail carriers renders the mail boxes highly susceptible to access by unauthorized persons. Thus, magazines, newspapers, parcels and checks deposited in conventional rural mailboxes are subject to theft or vandalism.

Since it is not functional for rural mail delivery purposes to employ a rural mailbox which requires unlocking by the mail carrier, heretofore persons on a rural mail delivery route have suffered the inconvenience associated with an insecure depository for their mail.

One mailbox device which provides a solution to this problem is disclosed in U.S. Pat. No. 3,758,027 to Morgan. Thus, this reference discloses a mailbox having upper and lower compartments interconnected by a trap door which defines a bottom for the upper compartment when in closed condition. The lower compartment is provided with a lock device so that only authorized persons have access thereto. This device, however, does not provide the convenience of oppositely faced access openings and the trap door design inherently places severe restrictions on the amount of usable space.

The following references disclose various types of locking mechanisms for depositories and receptacles:

U.S. Pat. No. 975,455—Prevost
U.S. Pat. No. 1,038,553—Hodgkinson
U.S. Pat. No. 1,110,779—Hartman
U.S. Pat. No. 1,219,360—Storms
U.S. Pat. No. 1,305,722—Kees
U.S. Pat. No. 1,458,200—Sloan
U.S. Pat. No. 1,478,552—Chapman
Great Britian Pat. No. 422,682—Jordan U.S. Pat. No. 975,455 to Prevost discloses a locking mechanism for a receptacle having oppositely faced outer and inner doors and which permits the outer door to be opened for inserting articles and then locked by the closing of the door after inserting the articles. The outer door cannot again be opened until the locking mechanism has been released by operation of the inner door. The inner door does not have a lock mechanism.

U.S. Pat. No. 1,038,583 to Hodgkinson discloses a locking mechanism for receptacles or covers to which access is gained by oppositely placed doors, one door which is locked automatically and so retained in its closed position until the other door has been both opened and closed again. The locking mechanism includes a latch, a lever having a plurality of arms and pivoted within the receptacle and having a hook on one arm adapted to engage the latch, and an unlocking device movably supported within the receptacle. This mechanism also lacks a locking device on the inner door.

U.S. Pat. No. 1,110,779 to Hartman discloses another locking mechanism for receptacle which locking mechanism automatically locks the outer door when it is closed so that it cannot be opened again until the inner door is opened; and when the inner door is closed, the locking device is so operated that the outer door may be opened once and then closed before it is again locked. This device also does not provide for locking of the inner door, and further, the front door locking mechanism is fixedly secured to the inner door.

U.S. Pat. No. 1,219,360 to Storms discloses a locking mechanism for use in receptacles having oppositely faced inner and outer doors in which the locking mechanism is so arranged that the outer door may be opened to permit the insertion of articles, and automatically locked when the outer door is closed, so that the outer door cannot again be opened from the outside until released by the opening of the inner door. Opening of the outer door sets the locking mechanism to lock once the outer door is again closed. The inner door is not provided with a locking mechanism.

U.S. Pat. No. 1,305,722 to Kees discloses a locking device for a receptacle having oppositely faced outer and inner doors wherein the locking device allows the outer door to be opened and articles inserted so that when the outer door is closed, it will be automatically locked until such time as it is released by rotating an indicator located above the inner door. An indicator is also provided which is visible on the inside, the position of which determines whether the outside door is locked or released. This device does not have a lock on the inner door, and opening and closing of the inner door has no effect upon the locking or unlocking of the outer door.

U.S. Pat. No. 1,458,200 to Sloan discloses a locking mechanism for a receptacle having oppositely faced outer and inner doors, which locking mechanism is releasable in order to open the outer door by closing the inner door. Once the outer door is again opened, it is automatically locked by subsequent closing of the outer door. The inner door is not provided with a locking mechanism.

U.S. Pat. No. 1,478,552 to Chapman discloses a locking means for deposit and collection receptacles, delivery boxes, or the like, to which access is had through oppositely placed doors. The locking means operates solely by the action of gravity in connection with the movement of the outer and inner doors. The device does not disclose a mechanism for locking the inner door.

Great Britain Pat. No. 422,682 to Jordan discloses a locking mechanism provided for a service hatch having oppositely faced inner and outer doors. The closure of the inner door operates the release mechanism which allows the other door to be opened once and then locked when next closed again. As with the previously described references, no locking means is disclosed for the inner door.

None of the above references, however, discloses a locking mechanism of the type disclosed in the present invention.

U.S. Pat. No. 3,675,845 to Scheerer and U.S. Pat. No. 3,891,139 to Redling disclose single door mailboxes having magnetically operated automatic signal mechanisms which are operated by sequential opening and closing of the mailbox door. These two devices, however, do not provide the double-door security locking features of the present invention.

SUMMARY OF THE INVENTION

One embodiment of the present invention provides a depository receptacle having an elongated housing including an upper wall and being open at first and second opposite ends. A front closure is movably mounted at the first end for closing said first end. A rear closure is movably mounted at the second end for closing said second end and each of the closures have an inner and outer surface. A locking mechanism is also provided for locking the front and rear closures. The locking mechanism includes a latching member formed of magnetically attractable material, a latching member mounting bracket mounting the latching member on the inner side of the front closure for limited vertical movement, a camming mechanism for engaging in moving the latching member in a vertical direction, a camming mechanism mounting bracket mounting the camming mechanism in the receptacle adjacent the upper wall and the latching member when the front closure is in closed position, and a magnet for magnetically attracting the latching member mounted on the upper wall adjacent the latching member. The camming mechanism mounting bracket includes a retaining portion engagable by the latching member in its lower position to latch the front closure in the closed position. The camming mechanism also includes a movable portion mounted adjacent the retaining portion and is engageable with the latching member for moving the latter out of engagement with the retaining portion to a position adjacent the magnet, whereby the latching member is attracted to and retained by the magnet. The camming mechanism further includes an actuating mechanism for moving the movable portion in response to opening and closing of the rear closure. The locking mechanism includes a lock mounted on the rear closure for locking the rear closure relative to the housing. Thus, with the latching member in latched engagement with the retaining portion, and with the front and rear closures in the closed position, when the rear closure is unlocked and opened, the actuating mechanism will move rearwardly toward the rear closure and the movable portion will move the latch member vertically out of engagement with the retaining portion to a position in which it is attracted and retained by the magnet to thereby unlatch the front closure. Subsequent closing of the rear closure causes the actuating mechanism to return the movable portion and the actuating mechanism to their original position with the front closure unlatched and closed. Upon opening the front closure, the latching member is moved out of engagement with the magnet and falls to its lower position so that upon closing of the front closure, the latching member again engages the retaining portion and latches the front closure in the closed position.

It is, therefore, an object of the present invention to provide an improved double-door security rural mailbox. This and other objects and advantages of the present invention will become more apparent in the following figures and detailed description.

DESCRIPTION OF THE PREFERRED EMBODIMENT

Figure 1:
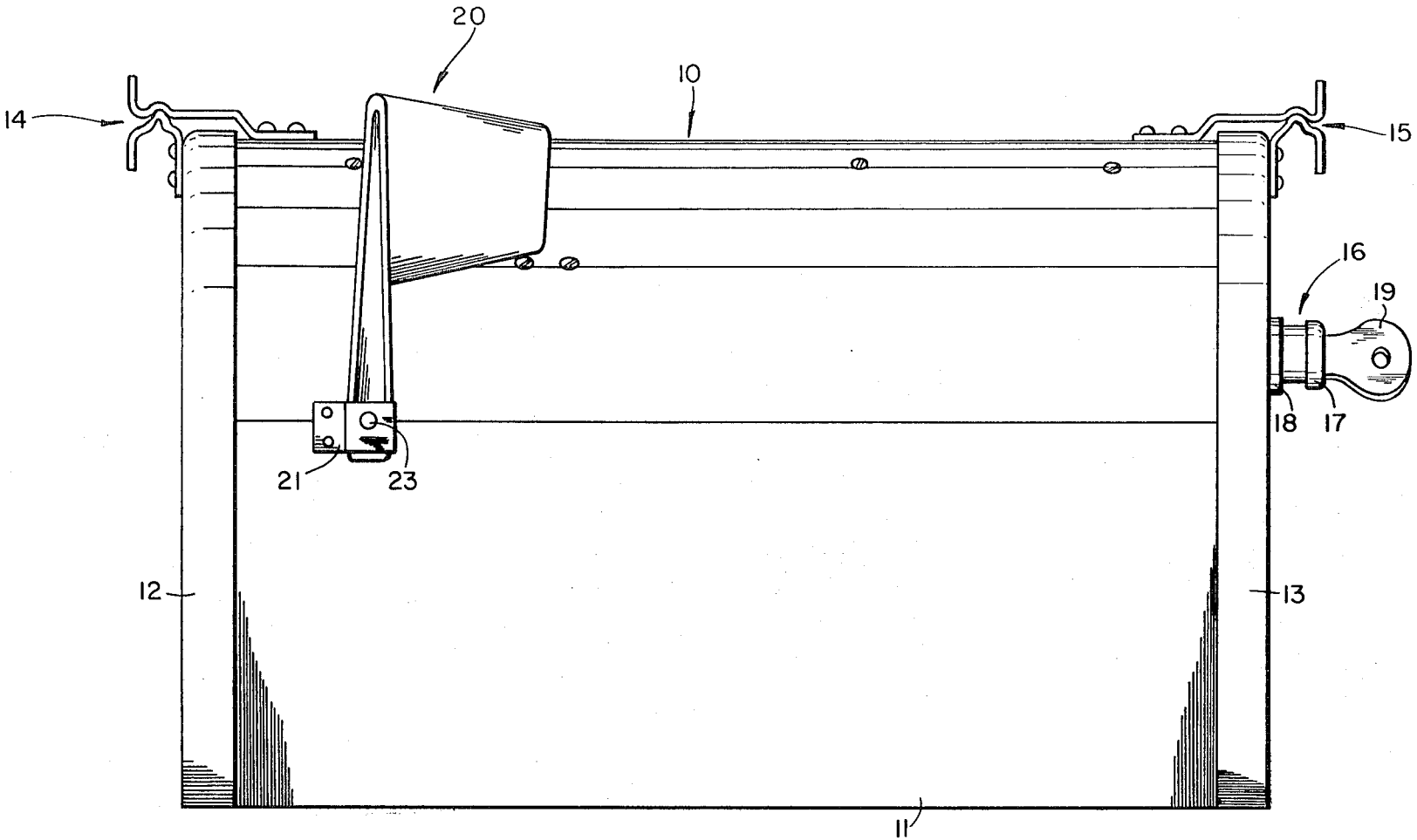
FIG. 1 is a side view illustrating the present invention incorporated into a mailbox.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, the double-door security rural mailbox of the present invention is generally designated at 10 and comprises a conventionally shaped elongate housing 11 having a curved top and a flat bottom portion. Front closure 12 and rear closure 13 are pivotally mounted on opposite ends of housing 11 and secured in their closed positions by conventional spring latches shown generally designated at 14 and 15. Front closure 12 and rear closure 13 are hinged horizontally at the bottom of housing 11 so that they pivot outwardly in opposite directions. A key operated lock generally designated at 16 includes a locking arrangement 17 mounted within rear closure 13 and secured thereto by lock washer 18. A key 19 is shown inserted within lock arrangement 17, but would of course normally be removed therefrom except when locking or unlocking rear closure 13.

A conventional type signal flag is generally designated at 20 and is shown in its upright position mounted to housing 11 by way of mounting bracket 21. Signal flag 20 is attached to mounting bracket 21 by rivet 23 which allows signal flag 20 to be pivoted on mounting bracket 21 in order to serve as an indicator for the presence of mail within housing 11. Thus, front closure 12 typically faces a road and is easily accessed by a mail carrier for depositing and removing mail from the mailbox. Rear closure 13 allows the recipient to remove mail from the mailbox without having to access the mailbox from a position dangerously close to the road.

Figure 2:
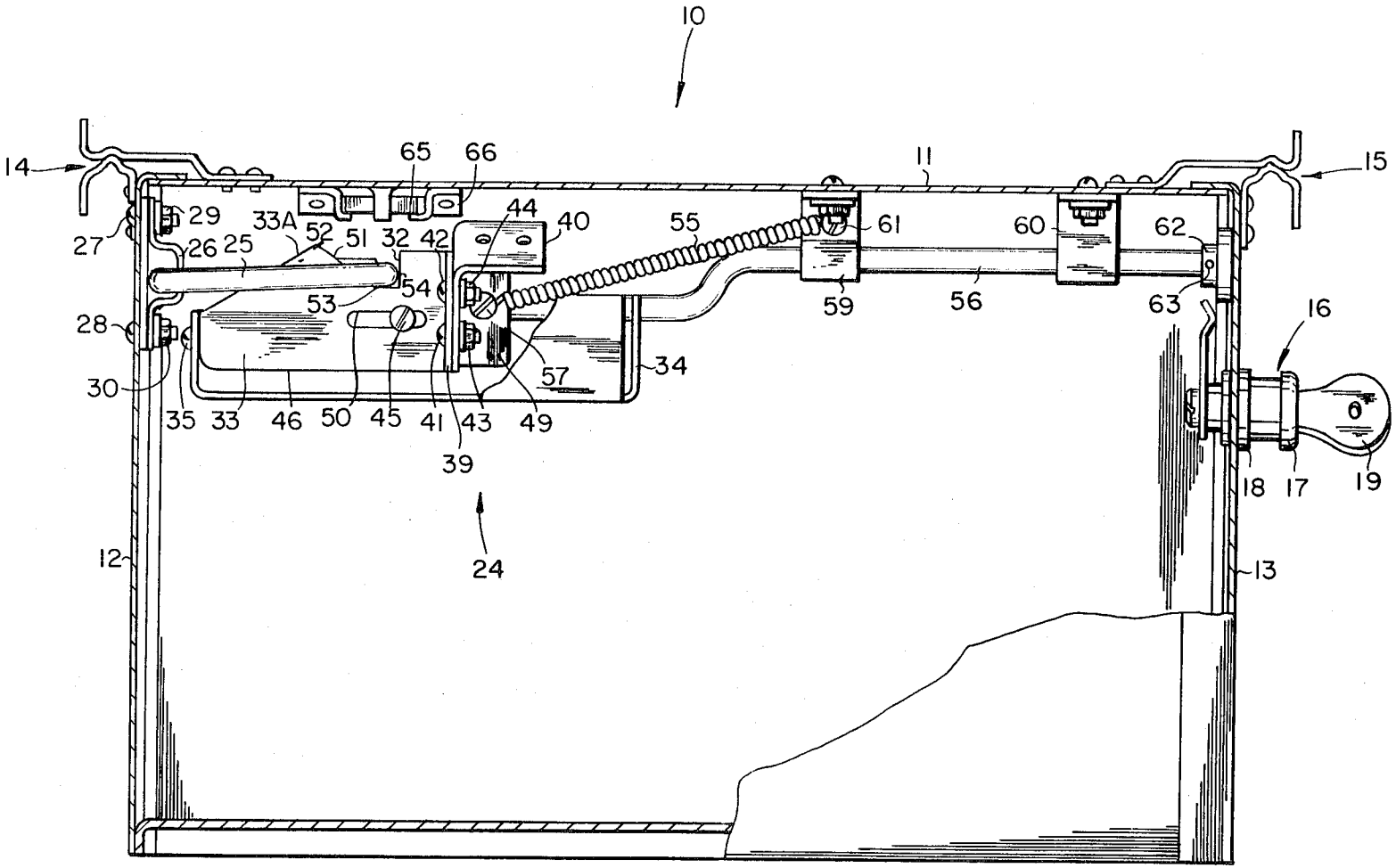
FIG. 2 is a cut-away side view illustrating the structural details of a first embodiment of the present invention with both the front and rear doors in the locked position.
Figure 5:
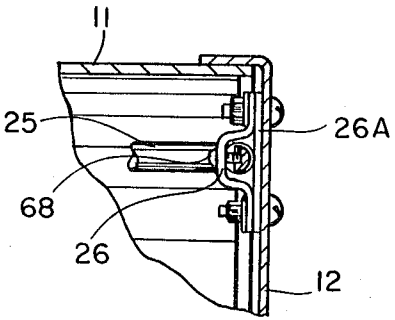
FIG. 5 is a cross-sectional view taken on lines 5—5 of FIG. 4.
Figure 4:
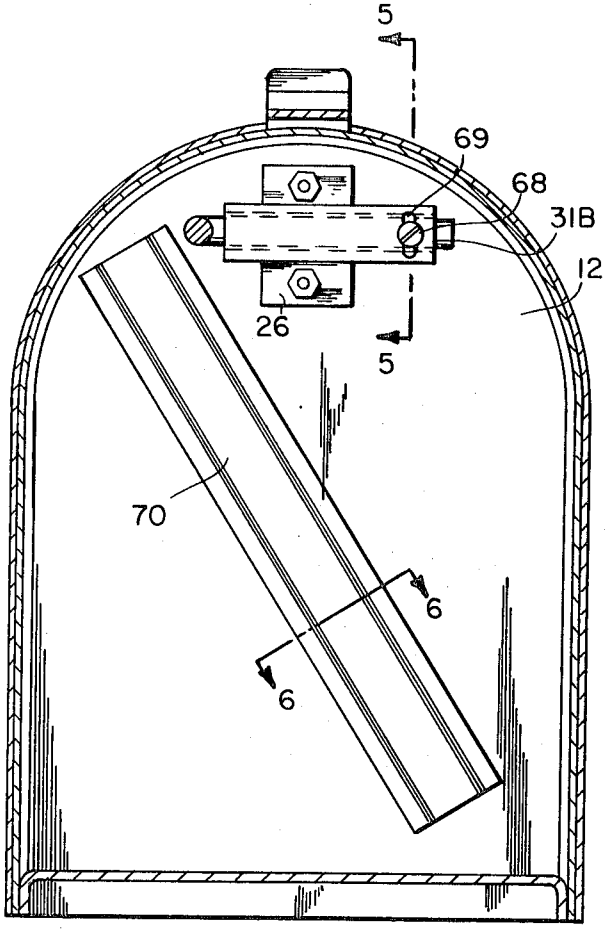
FIG. 4 is a cross-sectional view of the present invention taken on a line adjacent the front door showing the movable latch structure mounted on the rear of the front door.

Proceeding now to the interior of the present invention, FIG. 2 shows the front closure locking mechanism of the present invention generally designated at 24 enclosed within housing 11. A U-shaped latch member 25 is pivotally attached to front closure 12 within mounting bracket 26 which is fixedly secured to front closure 12 by bolts 27 and 28, and nuts 29 and 30. Thus, U-shaped latch member 25 pivots within mounting bracket 26 on an axis which is parallel to the surface of front closure 12. FIGS. 4 and 5 illustrate the connection between latch member 25 and front closure 12 in more detail. Front leg 31B of latch member 25 is secured in the channel between mounting bracket 26 and wear plate 26A by bolt 68 which is received through vertical slot 69 in mounting bracket 26. Vertical slot 69 limits the travel of bolt 68 and thus also the vertical travel of latch member 25, as will be more fully described hereinafter.

Figure 3:
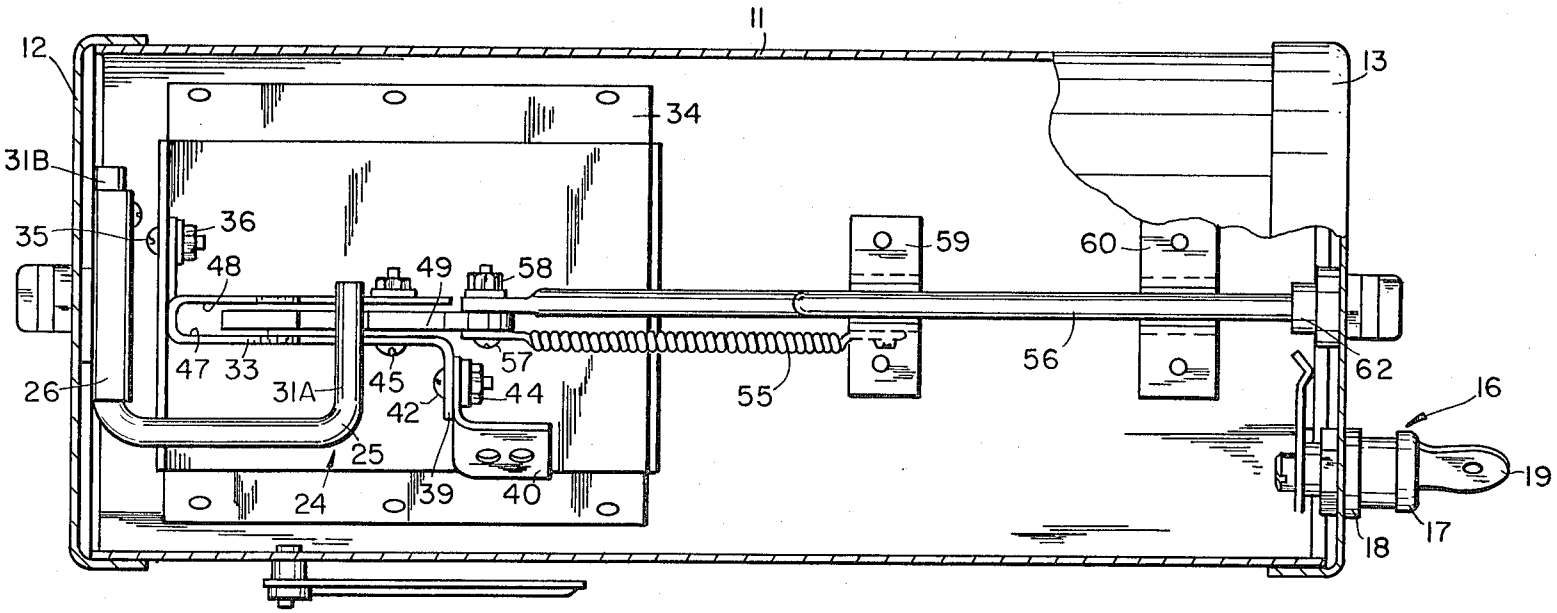
FIG. 3 is a cut-away top view of the embodiment of the invention shown in FIG. 2.
Figure 7:
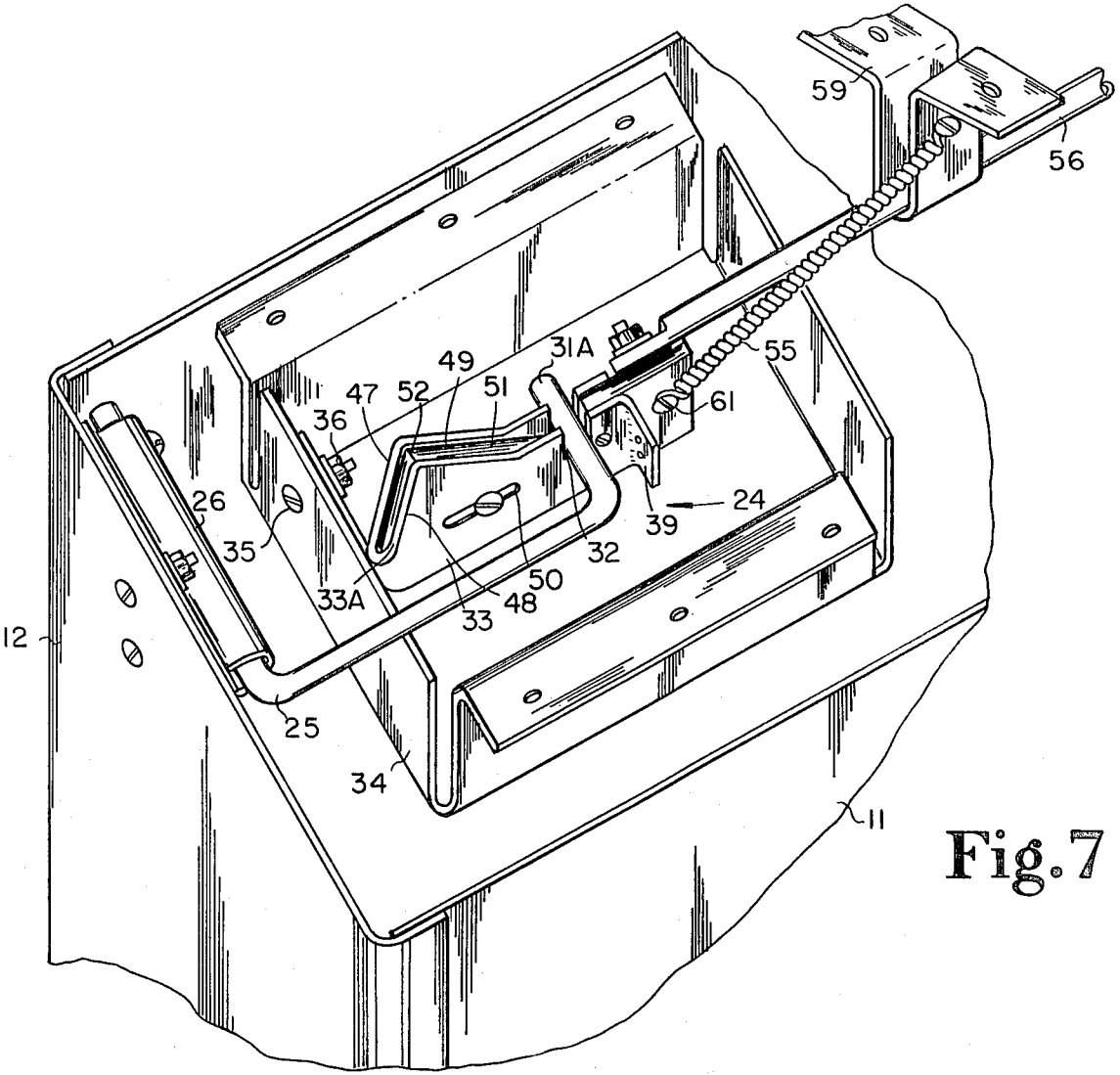
FIG. 7 is a cut-away perspective view showing the front portion of the embodiment of the invention shown in FIGS. 2 and 3.

Referring now also to FIGS. 3 and 7, the rear leg 31A of U-shaped latch member 25 is shown in a locked position received within slot 32 of cam mounting bracket 33. Cam mounting bracket 33 has a bevelled front surface 33A which allows rear leg 31A of latch member 25 to be easily guided into its locked position within slot 32 as front closure 12 is being closed. Cam mounting bracket 33 is fixedly secured at its forward end to protective housing 34 by bolt 35 and nut 36. Protective housing 34 is mounted to the inside facing upper wall of housing 11 and serves to protect portions of locking mechanism 24 from becoming jammed by contact with contents inserted within the mailbox.

Cam mounting bracket 33 has a flange 39 at its rear end for attachment to L-shaped bracket 40. A pair of bolts 41 and 42 and nuts 43 and 44 secure flange 39 to L-shaped bracket 40. L-shaped bracket 40 is secured to the upper wall of housing 11 by another pair of bolt and nut combinations (not shown). Cam mounting bracket 33 has an enclosed bottom and a pair of vertical side walls 47 and 48 defining a channel wherein cam 49 is slidably received. Cam 49 is attached to cam mounting bracket 33 for horizontal movement by bolt 45 which is received through an aperture in cam 49 and also through horizontal slot 50 which is defined by the vertical walls 47 and 48 in cam mounting bracket 33. Thus, the movement of cam 49 is controlled by the corresponding movement of bolt 45 within horizontal slot 50. Cam 49 is also supported by the bottom 46 of cam mounting bracket 33 so that cam 49 cannot pivot on bolt 45 as it is moved. Cam 49 has an upward facing cam surface which includes a bevelled edge 51 which inclines upwardly until it reaches apex 52 whereupon it inclines downwardly towards the front portion of cam 49. Horizontal surface 53 extends rearwardly from bevelled edge 52 towards vertical wall 54.

Referring to FIGS. 2 and 3, a spring 55 and lock rod 56 are secured on opposite sides of the rear portion of cam 49 by bolt 57 and nut 58. Lock rod 56 is slidably received within a pair of U-shaped guide brackets 59 and 60 which are bolted to the upper wall of housing 11. The other end of spring 55 is secured to guide bracket 59 by way of bolt 61. A rubber tip 62 is secured by pin 63 to the rear most end of lock rod 56. Spring 55 is biased such that when lock rod 56 is in its closed position with rear door 13 closed, spring 55 will be extended. As rear door 13 is opened, lock rod 56 is urged by spring 55 rearwardly until the bias upon spring 55 is relieved. Magnet 65 is positioned vertically above slot 32 and secured to the upper wall of housing 11 by mounting bracket 66.

Figure 6:
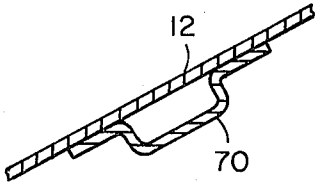
FIG. 6 is a cross-sectional view taken on lines 6—6 of FIG. 4 and showing a door brace.

FIG. 4 shows front closure 12 having a door brace 70 which serves to stiffen front closure 12, thereby making it stronger and less susceptible to entry by unauthorized persons. FIG. 6 shows a cross-sectional view of door brace 70 which may be attached to front closure 12 by spot welding.

The operation of the double-door security mailbox of the present invention may be described as follows. With the front closure 12 and rear closure 13 in their closed positions and with U-shaped latch member 25 received within slot 32 of cam mounting bracket 33 in its locked position the owner may access the mailbox from rear closure 13 by unlocking key operated lock 16 with key 19 in a well known manner. Upon opening rear closure 13, lock rod 56 moves rearwardly under the urging of spring 55 until the tension in spring 55 is relieved. This causes cam 49 to slide rearwardly within cam mounting bracket 33. Cam 49 is prevented from moving in any direction other than horizontal by the cooperation of bolt 45 within horizontal slot 50. As cam 49 moves rearwardly, bevelled edge 51 of cam 49 urges the rear leg 31A of latch member 25 vertically upwards until it is captured by magnetic attraction from magnet 65 and becomes attached thereto. Once rear closure 13 is closed, cam 49 slides forwardly to a position which allows slot 32 to again receive latch member 25. When the mail carrier opens front closure 12, contact between latch member 25 and magnet 65 is broken. After mail has been inserted within housing 11 the mail carrier closes front closure 12. As this is done, the rear leg 31A of latch member 25 contacts the front bevelled surface 33A of cam mounting bracket 33 and is guided rearwardly until it falls within slot 32, locking front closure 12. Vertical slot 69 in mounting bracket 26 ensures that the rear leg 31A of latch member 25 cannot pivot below the height of front bevelled surface 33A as front closure 12 is being closed. Once front closure 12 is closed the mailbox may only be accessed from the rear closure 13 by using key 19 as previously described.

Figure 2A:
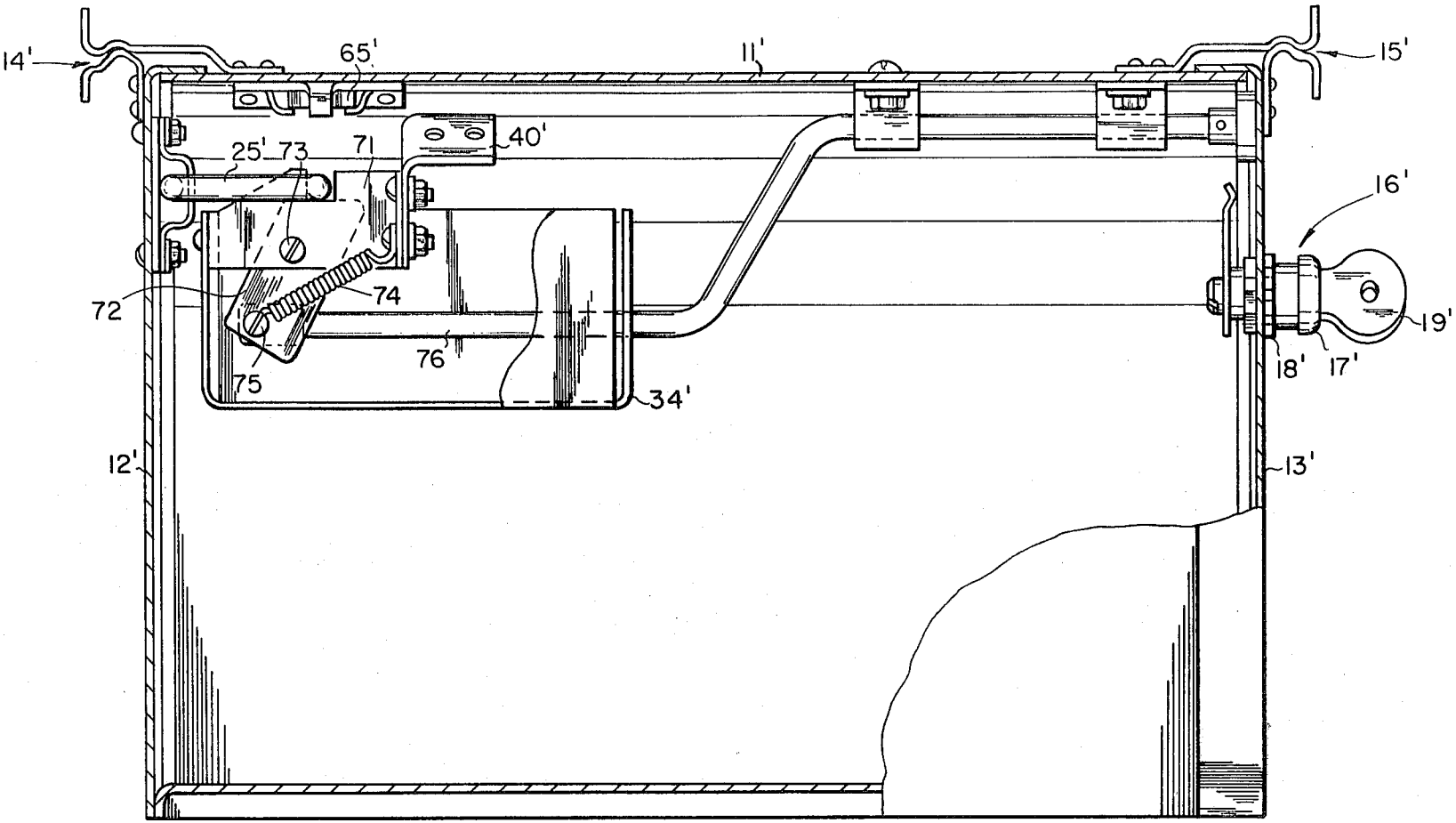
FIG. 2A is a cut-away view illustrating the structural details of a second embodiment of the present invention with both the front and rear doors in the locked position.
Figure 3A:
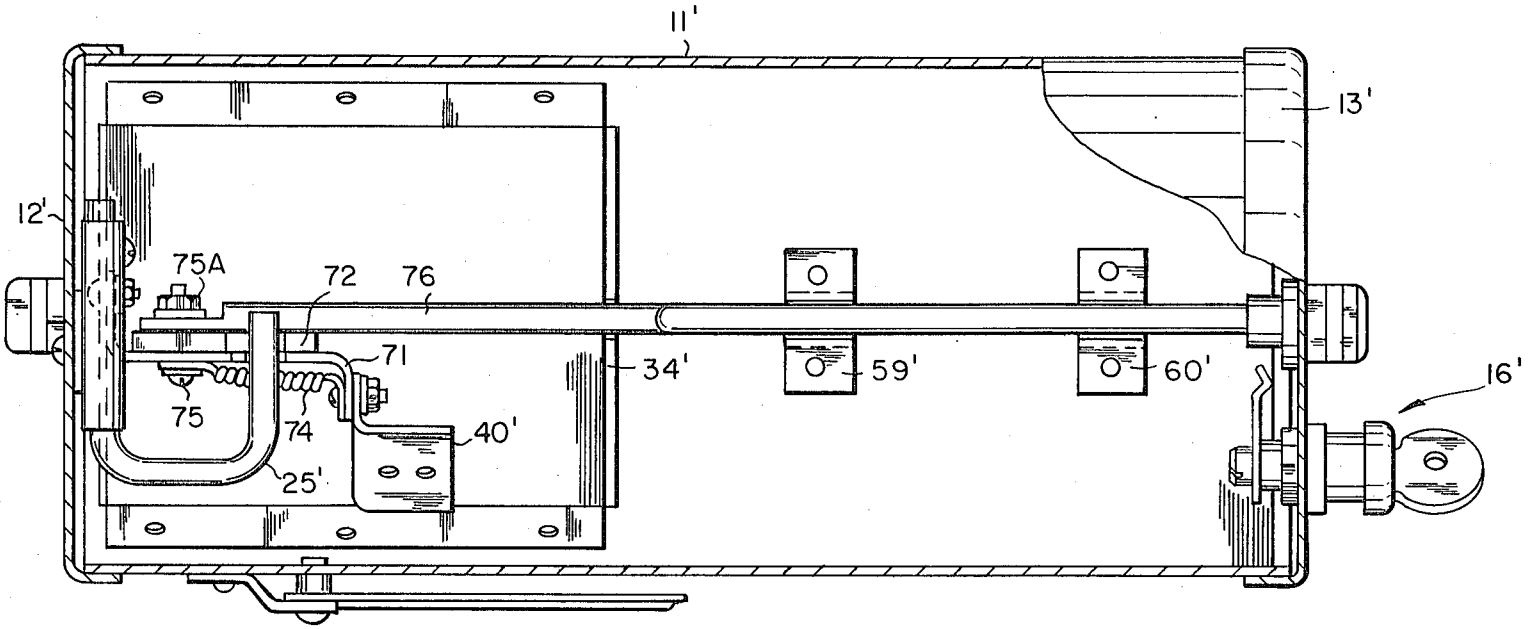
FIG. 3A is a cut-away top view of the embodiment of the invention shown in FIG. 2A.
Figure 7A:
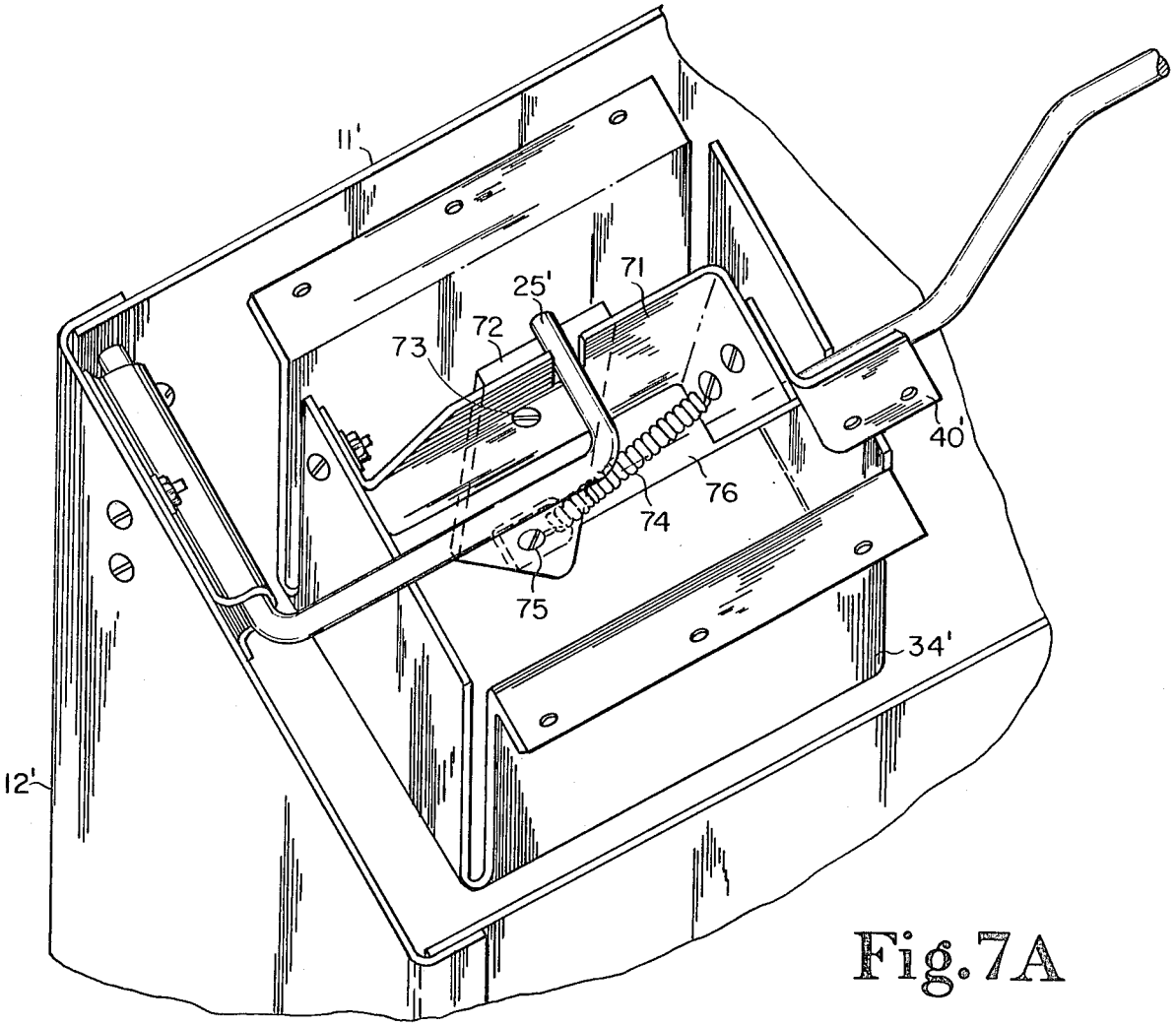
FIG. 7A is a cut-away perspective view similar to FIG. 7, but showing the embodiment of the invention shown in FIGS. 2A and 3A.

In FIGS. 2A, 3A, and 7A a second preferred embodiment of the present invention is shown. It should be noted that parts similar to those previous disclosed have been indicated with primed numerals. In this embodiment cam 72 is pivotally attached to cam mounting bracket 71 by bolt 73. Spring 74 is attached to one side of cam 72 by bolt 75 and nut 75A. Spring 74 is attached at its other end to flange 39' of cam mounting bracket 71. One end of lock rod 76 is secured to cam 72 by bolt 75 on the side opposite spring 74. The rear portion of lock rod 76 is slidably connected to housing 11' in the manner previously described for the first embodiment of the present invention. Spring 74 is biased such that when rear closure 13' is in its closed position spring 74 will be extended. Thus, as lock rod 76 moves rearwardly upon opening of rear closure 13' the tension on spring 74 forces cam 72 to pivot on bolt 75 and thereby urges latch member 25' to lift vertically out of slot 32' until it is captured by magnet 65' in a manner previously described for the first embodiment.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A depository receptacle, comprising:

an elongated housing including an upper wall and being open at first and second opposite ends;

a front closure movably mounted at said first end for closing said first end;

a rear closure movably mounted at said second end for closing said second end, each of said closures having an inner and an outer surface;

a locking mechanism for locking said front and rear closures, said locking mechanism including a latching member formed of magnetically attractable material, a latching member mounting bracket mounting said latching member on the inner side of said front closure for limited vertical movement, a camming mechanism for engaging and moving said latching member in a vertical direction, a camming mechanism mounting bracket mounting said camming mechanism in said receptacle adjacent said upper wall and said latching member when said front closure is in a closed position, a magnet for magnetically attracting said latching member mounted on said upper wall adjacent said latching member, said camming mechanism mounting bracket including a retaining portion engageable by said latching member in its lower position to latch said front closure in the closed position, said camming mechanism including a movable portion mounted adjacent said retaining portion and engageable with said latching member for moving the latter out of engagement with said retaining portion to a position adjacent said magnet, whereby said latching member is attracted to and retained by said magnet; said camming mechanism further including an actuating mechanism for moving said movable portion in response to opening and closing of said rear closure, said locking mechanism including a lock mounted on said rear closure for locking the rear closure relative to said housing; whereby with the latching member in latched engagement with the retaining portion and with the front and rear closures in the closed position; when the rear closure is locked and opened, the actuating mechanism will move rearwardly toward the rear closure and the movable portion will move the latching member vertically out of engagement with the retaining portion to a position in which it is attracted and retained by the magnet to thereby unlatch the front closure, subsequent closing of the rear closure causing the actuating mechanism to return the movable portion and the actuating mechanism to their original position with the front closure unlatched and closed; upon opening of the front closure, the latching member is moved out of engagement with the magnet and falls to its lower position so that upon closing of the front closure, the latching member again engages the retaining portion and latches the front closure in the closed position.

2. The device as claimed in claim 1, wherein the actuating mechanism includes a connecting portion connected to said movable portion and an engaging portion engageable with said rear closure, said actuating mechanism further including a means for rearwardly urging said connecting portion in a direction to move said movable portion in a direction to raise said latching member.

3. The device as claimed in claim 2, wherein said means for rearwardly urging said connecting portion is a spring biasing means, and said lock is a key operated lock.

4. The device as claimed in claim 3 wherein said connecting portion and said engaging portion of said actuating mechanism are formed at opposite ends of an elongated member, said elongated member being mounted on said upper wall for generally horizontal movement toward and away from said second end of said housing.

5. The device claimed in claim 3 wherein said retaining portion of said camming mechanism mounting bracket is formed by a vertical side of an upwardly open recess formed in the upper portion of said bracket and said camming mechanism mounting bracket includes an inclined surface sloping toward said front closure from adjacent the upper open end of said recess to a position below said recess, whereby the latching member is engageable with said inclined surface when in its lower position.

6. The device as claimed in claim 3 wherein said latching member comprises a generally U-shaped member having one leg of the member received in the latching member mounting bracket and the other leg being engageable with the retaining portion of said camming mechanism mounting bracket.

7. The device as claimed in claim 3, wherein a protective enclosure is provided which generally surrounds said camming mechanism mounting bracket and said connecting portion of said actuating mechanism.

8. The device claimed in any one of claims 3, 4, 5, 6, or 7 wherein said movable portion of said camming mechanism comprises a cam member mounted on said camming mechanism mounting bracket for movement in a horizontal direction toward and away from said front closure and said cam member having an upper cam surface inclined toward said front closure for engaging said latching member to move the latter vertically.

9. The device claimed in any one of claims 3, 4, 5, 6, or 7 wherein said movable portion of said camming mechanism comprises a cam member mounted on said camming mechanism mounting bracket for pivotal movement about a horizontal axis and said cam member having an upper horizontal cam surface for engaging said latching member to move the latter vertically.

* * * * *